US009955759B2

(12) United States Patent
Crafton

(10) Patent No.: US 9,955,759 B2
(45) Date of Patent: May 1, 2018

(54) JEWELRY COVER AND METHOD OF PROTECTING JEWELRY

(71) Applicant: Bryan C. Crafton, Chevy Chase, MD (US)

(72) Inventor: Bryan C. Crafton, Chevy Chase, MD (US)

( * ) Notice: Subject to any disclaimer, the term of this patent is extended or adjusted under 35 U.S.C. 154(b) by 329 days.

(21) Appl. No.: 14/622,242

(22) Filed: Feb. 13, 2015

(65) Prior Publication Data

US 2016/0235170 A1 Aug. 18, 2016

(51) Int. Cl.

| | |
|---|---|
| ***A44C 25/00*** | (2006.01) |
| ***A44C 7/00*** | (2006.01) |
| *A44C 19/00* | (2006.01) |

(52) U.S. Cl.

CPC ..... *A44C 7/003* (2013.01); *A44C 19/00* (2013.01)

(58) Field of Classification Search

CPC ..... A44C 7/00; A44C 7/002; A44C 19/00; A44C 7/003; A45C 11/04; A45C 11/16; A45C 13/002; B08B 1/00; B08B 11/02

USPC ..... 63/33, 40; 15/104.94, 104.93, 210.1

See application file for complete search history.

(56) References Cited

U.S. PATENT DOCUMENTS

| | | | | |
|---|---|---|---|---|
| 249,202 | A * | 11/1881 | Oliver | A44C 7/00 63/12 |
| 4,195,492 | A | 4/1980 | Johnson | |
| D273,472 | S | 4/1984 | Goldstein | |
| 4,608,838 | A | 9/1986 | Gardner | |
| 4,682,477 | A | 7/1987 | Vaillancourt | |
| 4,687,441 | A | 8/1987 | Klepachi | |
| 4,793,155 | A | 12/1988 | Law | |
| 4,813,091 | A * | 3/1989 | Glasener | A46B 9/02 15/104.04 |
| 5,337,584 | A | 8/1994 | Angeli | |
| 5,472,281 | A * | 12/1995 | Phelps | A45C 11/24 150/150 |
| 7,204,691 | B2 | 8/2007 | Darling | |
| D660,743 | S | 5/2012 | Crafton | |
| 8,683,826 | B2 | 4/2014 | Crafton | |
| 2012/0240623 | A1 | 9/2012 | Morse | |
| 2014/0352857 | A1 | 12/2014 | Warren | |

* cited by examiner

*Primary Examiner* — Jack W Lavinder

(74) *Attorney, Agent, or Firm* — Garcia-Zamor IP Law; Ruy M. Garcia-Zamor

(57) ABSTRACT

A method of protecting earrings or jewelry.

10 Claims, 6 Drawing Sheets

JEWELRY COVER AND METHOD OF PROTECTING JEWELRY

BACKGROUND

The present invention relates generally to covers and, more specifically, to a protective earring cover which may be attached to a piece of jewelry by a user.

Earrings and general pieces of jewelry are often regarded as highly valuable items, representing large financial investments as well as nostalgic importance. Conventionally, an earring or piece of jewelry may draw unwanted attention when adorned in an inappropriate setting. For example, a user may be walking from a vehicle to a ceremony or party, and the display of such highly valued items can draw unwanted attention. Additionally, the use of highly-valued earrings and jewelry can present them to the risk of dirt, damage, and overall wear-and-tear during times when they are worn between functions.

It may be advantageous to provide a cover which: may attach to an existing decorative, non-adjustable earring or piece of jewelry; may fully enclose the earring or jewelry; partially encloses the earring or jewelry; can seal off the jewelry from adverse elements, including dirt, water, and debris; may provide a protective casing for the finish; can conceal the appearance of the earring or piece of jewelry, such that the appearance of the earring or jewelry is not readily presented; may allow for quick and efficient use; can be easily manufactured; is preferably efficient to manufacture; and/or protects and treats a finish of or otherwise conditions the earring or jewelry.

SUMMARY

In one aspect, one preferred embodiment of the present invention is directed to a method of protecting a decorative, finished, non-adjustable earring. The method preferably includes the steps of providing a cover having a main body having first and second surfaces positioned on opposing sides. The first surface may be configured to cover a side of the earring opposite of the back of the earring (i.e. opposite the ear clip portion of the earring). The second surface may be further define a cavity configured to receive a portion of the earring. The second surface may additionally comprise a deformable lip disposed about the cavity, such that the lip is configured to secure the earring within the main body.

In another aspect, one embodiment of the present invention is directed to a method of protecting decorative, finished, non-adjustable jewelry. The method preferably includes the steps of providing a cover having a main body having first and second surfaces positioned on opposing sides. The first surface may be configured to cover a side of the jewelry opposite of the back of the jewelry (i.e. opposite the adornment or decorative portion of the jewelry). The second surface may be further define a cavity configured to receive a portion of the jewelry. The second surface may additionally comprise a deformable lip disposed about the cavity, such that the lip is configured to secure the jewelry within the main body.

In another aspect, one preferred embodiment of the present invention is directed to a method of protecting a decorative, finished, non-adjustable earring. The method preferably includes the steps of providing a cover having a main body having first and second surfaces positioned on opposing sides. The first surface may be configured to cover a side of the earring opposite of the back of the earring (i.e. opposite the ear clip portion of the earring). The first surface may further be configured to provide a space between the interior surface of the first surface and the earring. The second surface may be further define a cavity configured to receive a portion of the earring.

In another aspect, one preferred embodiment of the present invention is directed to a method of protecting a decorative, finished, non-adjustable earring. The method preferably includes the steps of providing a cover having an interior cavity surface which acts as a treatment interface with the earring, including a fluid disposed therein.

In another aspect, one preferred embodiment of the present invention is directed to a method of protecting a decorative, finished, non-adjustable earring. The method preferably includes the steps of providing a cover having an interior cavity surface which acts as a treatment interface with the earring, including a plurality of bristles configured to promote the cleaning and polishing of the earring.

In another aspect, one preferred embodiment of the present invention is directed to a method of protecting a decorative, finished, non-adjustable earring. The method preferably includes the steps of providing a cover having an interior cavity surface which acts as a treatment interface with the earring, including a felt liner configured to promote the cleaning and polish of the earring.

In another aspect, one preferred embodiment of the present invention is directed to a method of protecting a decorative, finished, non-adjustable earring. The method preferably includes the steps of providing a cover having an interior cavity surface which acts as a treatment interface with the earring, including a plurality of projections configured to promote the cleaning and polish of the earring.

In another aspect, one preferred embodiment of the present invention is directed to a method of protecting a decorative, finished, non-adjustable earring. The method preferably includes the steps of providing a cover having an outer casing which entirely or partially encloses the first surface. The combination of the first surface and the outer casing may form a rectangular, hemispherical, or other shape depending upon the shape of the earring to be covered.

In another aspect, one preferred embodiment of the present invention is directed to a method of protecting a decorative, finished, non-adjustable earring. The method preferably includes the steps of providing a cover having a hook attachment may be further provided which extends from the main body of the cover toward the back of the earring, providing an additional point of attachment, preferably along the post and clamp of the earring to be covered.

In another aspect, one preferred embodiment of the present invention is directed to a method of protecting a decorative, finished, non-adjustable earring. The method preferably includes the steps of providing a cover and twisting the cover to create engagement between the treatment interface and the front of the earring prior to removal of the cover such that when the cover is removed, the earring has been conditioned to encourage improvement of visual appeal.

In another aspect, one preferred embodiment of the present invention is directed to a method of protecting a decorative, finished, non-adjustable earring. The method preferably includes the steps of providing a cover having a main body having first and second surfaces positioned on opposing sides. The first surface may be configured to cover a side of the earring opposite of the back of the earring (i.e. opposite the ear clip portion of the earring). The second surface may be further define a cavity configured to receive a portion of the earring. The second surface may additionally comprise a deformable lip disposed about the cavity, such that the lip is configured to secure the earring within the main body. The main body may further include a decorative attachment which may extend from the main body.

In another aspect, one preferred embodiment of the present invention is directed to an earring cover including a front face configured to cover an earring. A main body is configured to enclose the earring. The main body is preferably hollow and configured to extend from the front face in a plane perpendicular to the front face such that a recess is formed therein. A lip is attached to the main body opposite the front face. The lip is preferably parallel to the front face and configured to secure an earring within the main body.

In another aspect, one preferred embodiment of the present invention is directed to a jewelry cover, including a front face configured to cover jewelry. A main body is configured to enclose jewelry. The main body may be hollow and configured to extend from the front face in a plane perpendicular to the front face such that a recess is formed therein. A lip can be attached to the main body opposite the front face such that the lip is parallel to the front face and configured to secure jewelry within the main body.

In another aspect, one preferred embodiment of the present invention is directed to an earring cover comprising a main body and a lip configured to resiliently deform against an earring to be engaged.

In another aspect, one preferred embodiment of the present invention is directed to a jewelry cover comprising a main body and a lip configured to resiliently deform against jewelry to be engaged.

In another aspect, one preferred embodiment of the present invention is directed to a method of protecting a decorative, finished, non-adjustable earring or of protecting an adjustable earring. The method preferably includes the steps of providing a cover having a main body having first and second surfaces positioned on opposing sides. The first surface may be configured to cover a side of the earring opposite of the back of the earring (i.e. opposite the ear clip portion of the earring). The second surface may define a cavity configured to receive a portion of the earring. An interior cavity surface may comprise a treatment interface configured to condition the earring.

In another aspect, one preferred embodiment of the present invention is directed to a method of protecting a decorative, finished, non-adjustable earring or of protecting an adjustable earring. The method preferably includes the steps of providing a cover having a casing thereover which provides the outward appearance of a larger earring stud while covering the actually worn earring in a generally sealed fashion. The cover may include an interface surface that is also configured to condition the actually worn earring. The casing may be configured to provide the visual impression of costume or low value jewelry.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

DETAILED DESCRIPTION OF THE PREFERRED EMBODIMENTS

Figure 1:
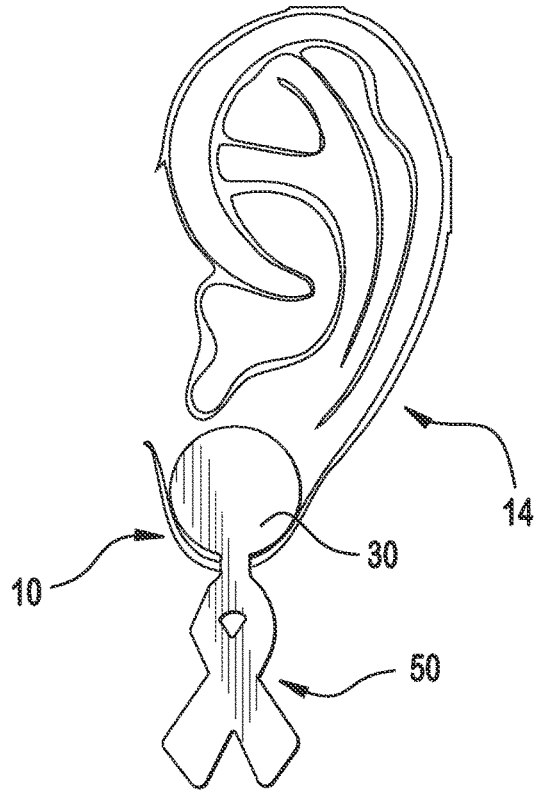
FIG. 1 is a front elevational view of an earring cover according to a preferred embodiment of the present invention; The earring cover may be used when an earring to be covered is in position on a user's ear, however the earring cover may be used whenever it is desired that an earring be covered; The front face of the earring cover is shown with a cylindrical shape, however, any shape can be used without departing from the present scope of the invention; A decorative attachment is further shown extending away from the main body in the shape of a ribbon, however any shape or design of decorative attachment may be used without departing from the present scope of the invention.

Certain terminology is used in the following description for convenience only and is not limiting. The words "right", "left", "top", "bottom", designate directions in the drawings to which reference is made. The term "vertical" and "horizontal" refer to generally planar positions relative to the structure which the collapsible basket is to be attached. The term "non-adjustable earrings", as used in the claims and associated portions of the specification, is defined as meaning "earrings that have a fixed outward appearance in that components/portions of the earrings (not including clips or the like that are used to secure the end of a post to the inner side of a wearer's ear) are not detachable or interchangeable to change the aesthetic appearance of the earring". "Vertical" refers to a generally up and down position, while "horizontal" refers to a generally left to right position. The term "first surface", as used in the claims and corresponding portions of the specification means any surface configuration not limited by shape or size. The term "second surface" similarly defines any surface without constraint to the size or shape of the surface. The term "cavity" refers to a generally hollow portion of the main body of the cover. Additionally, the words "a" and "one" are defined as including one or more of the referenced items unless specifically stated otherwise. The terminology includes the words above specifically mentioned, derivatives thereof, and words of similar import.

Referring to FIGS. 1-16, wherein like numerals indicate like elements throughout, preferred embodiments of a cover according to the present invention are shown and generally designated as 10. Briefly speaking the cover 30 can be fixed to an earring 12, a piece of jewelry 16, or any other structure in which it is desired to conceal the structure without departing from the scope of the invention.

The cover 10 may fully or partially enclose and conceal the earring 12 or jewelry 16. A user may place the cover 30 over the earring 12 or piece of jewelry when the display of the valuable is not desired, and then remove the cover 30 when in an appropriate setting for such a valuable item. For example, when going out to dinner in an restaurant in a downtown location a person can wear the cover 30 until about to enter the establishment to avoid encouraging mugging or other unwanted attention. Alternatively, a user may place the cover 30 over the earring 12 or jewelry 16 when transporting themselves from one location to another via public transportation or the like, thereby protecting the investment during transportation. It may further be desirable to protect the finish of an earring 12 or piece of jewelry 16, such that the piece is protected from marring or the outside elements. In this way, an earring or jewelry cover 30 may protect and seal out the outside elements such that the finish is preserved.

Referring now to FIG. 1, the cover 30 is preferably formed from a polymer material, however those of ordinary skill in the art will appreciate from this disclosure that any material, such as a metal, wood, or plastic may be used without departing from the scope of the invention. The cover may additionally be provided with a decorative attachment 50. The decorative attachment 50 may be any size, shape, or design and still remain within the scope of the invention.

Figure 2:
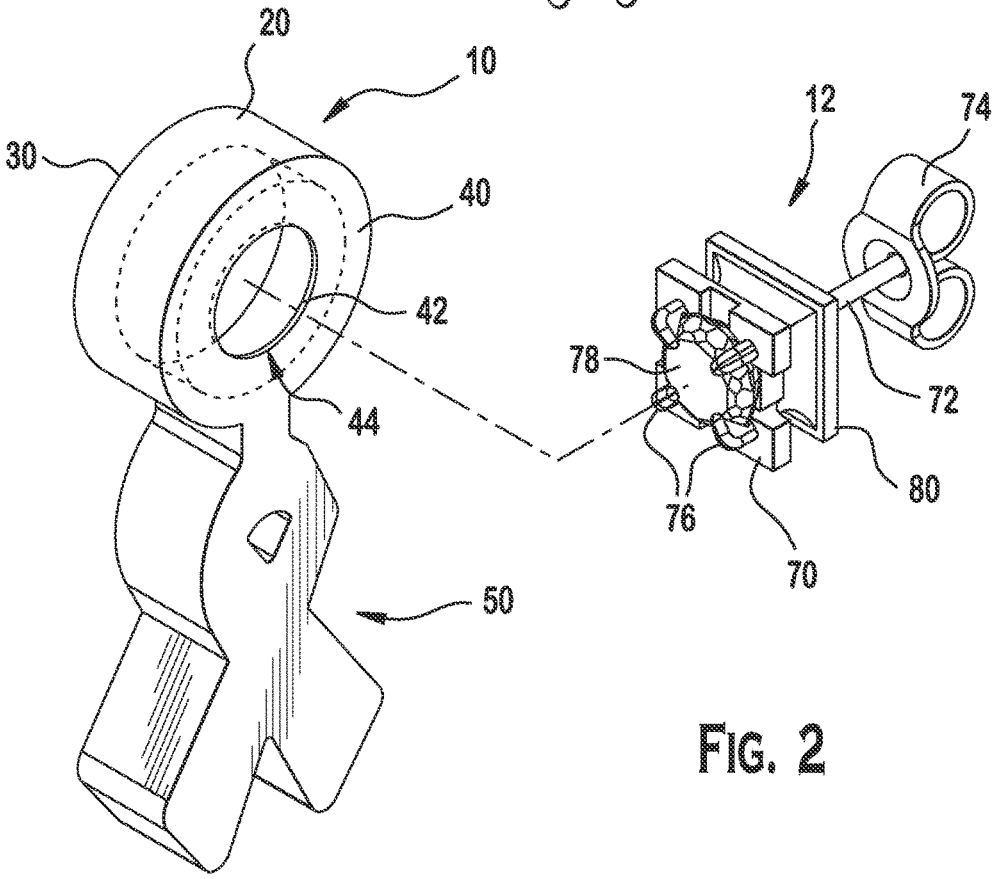
FIG. 2 is a perspective view of the earring cover of FIG. 1 illustrating a preferred method of mounting an earring within the cover; The earring is shown inserting into the cover along an axis of insertion; The earring may be slid past the lip of the second surface of the main body such that a portion of the earring is engaged within the cavity defined by the second surface; An earring with a stone and clasps is shown in the embodiment illustrated, however, those of ordinary skill in the art will appreciate from this disclosure that any earring design may be used without departing from the scope of the invention.

Referring to FIG. 2, a first preferred method of protecting decorative, finished, non-adjustable earrings according to the present invention is as follows. The method including the steps of providing a cover 10 comprising a main body 20 including a first surface 30 and second surface 40. The second surface 40 may further include a lip 42 to engage and seal along an earring 12. The earring 12 may include a bracket earring 70, post 72, and clip 74. The ornament of the earring may include a stone 78 secured by clasps 76. The brace bracket 70 may further include a plate 80 between the stone 78 and the clip 74. A decorative attachment 50 is further shown attached to the main body 20. The decorative attachment 50 is illustrated as a decorative ribbon, however, those of ordinary skill in the art will appreciate from this disclosure that any decorative design or shape may be used without departing from the scope of the invention.

The method of protecting an earring further includes the step of inserting the earring 12 past the lip 42 and into the cavity 22 formed by the second surface 40. FIG. 2 illustrates an axis of insertion along which the earring may be positioned within the cover 10. The lip 42 is illustrated as a circular orifice 44, however the lip may be any shape to accommodate a variety of earring designs.

Figure 3:
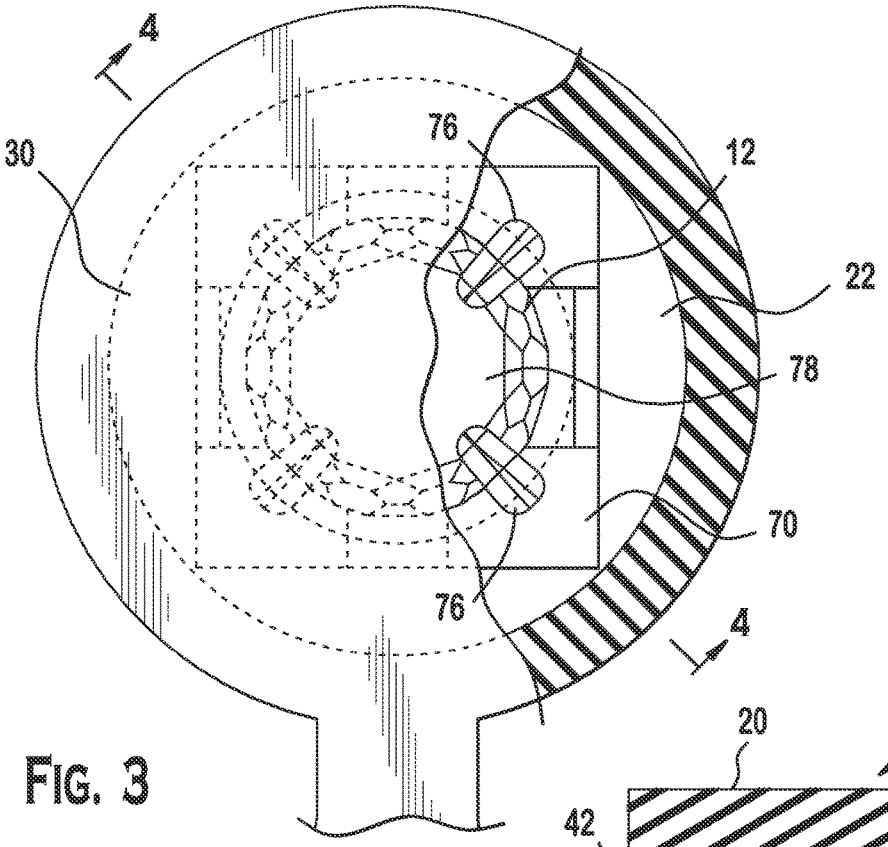
FIG. 3 is a front elevational, partially broken away view of the earring cover of FIG. 1 illustrating the earring fully inserted into the cavity of the cover; The earring is shown in dashed lines where it would appear beyond the first surface; A partial cut-away of the first surface is provided to show the earring (in solid lines) inserted within the cavity; The earring cover is preferably formed from a polymer material, however, Those of ordinary skill in the art will appreciate from this disclosure that any material may be used without departing from the scope of the invention.

Referring to FIG. 3, the cover 10 may fully accommodate the bracket earring 70 within the cavity 22. The stone 78 and clasps 76 may also be fully enclosed by the cover 10. The cover 10 is illustrated with a circular cavity 22, however, those of ordinary skill in the art will appreciate from this disclosure that any shape of cavity may be used within the main body 20 without departing from the scope of the invention. For example, the cavity may be rectangular, circular, or any other suitable shape.

Figure 4:
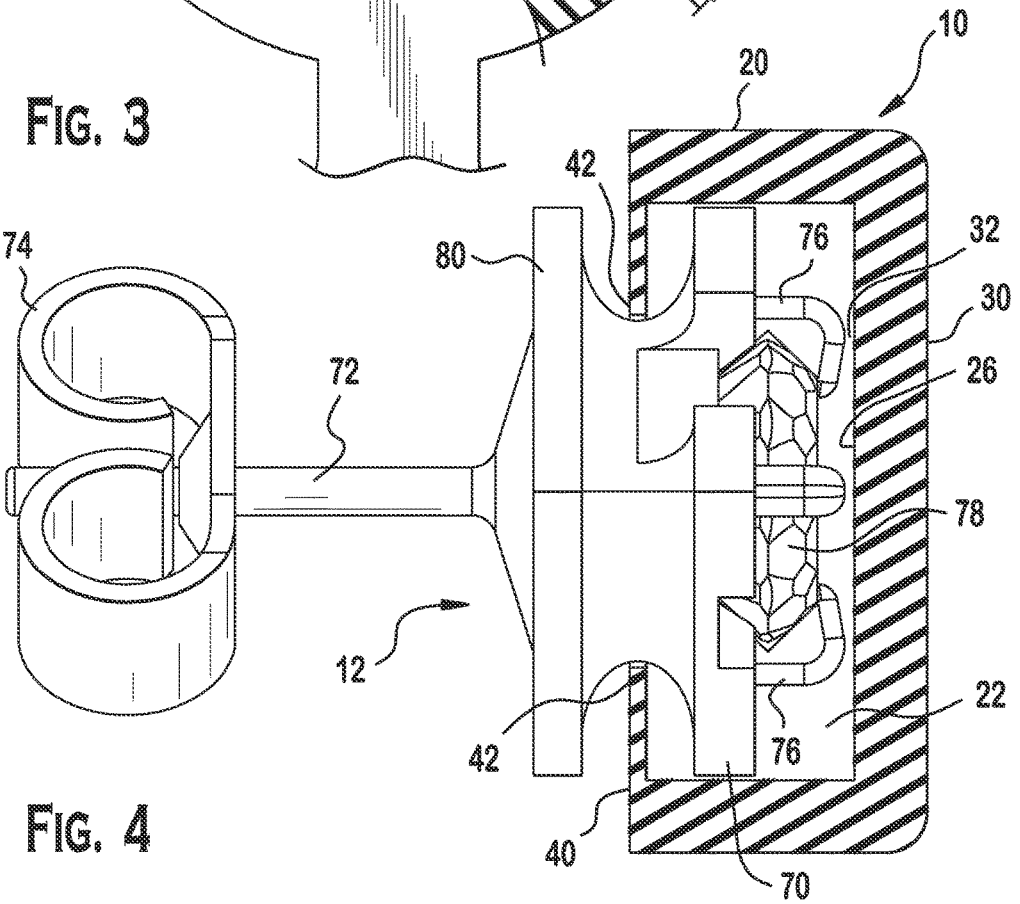
FIG. 4 is a cross sectional view of the earring cover of FIG. 3 as taken along the line 4-4 in FIG. 3; The earring cover is shown with the second surface defining a lip about the opening to a cavity within the main body of the cover; The lip is shown engaging an intermediary portion of the earring, however, the lip may engage the earring along any portion thereof without departing from the scope of the invention; The cavity of the main body is further shown with a rectangular cross-section, however, those of ordinary skill in the art will appreciate from this disclosure that any cavity cross-section may be used without departing from the scope of the invention; For example, the cavity cross-section may be square, cylindrical, triangular, or the like. Additionally, the cavity is shown providing a space between the interior cavity surface and the earring, however, those of ordinary skill in the art will appreciate from this disclosure that the earring may contact the interior surface of the cavity without departing from the scope of the invention.

Referring to FIG. 4, the cover 10 is shown fully enclosing the earring 12. The brace bracket 70 is shown partially enclosed within the main body 20 such that the lip 42 engages the earring 12 between the bracket earring 70 and the plate 80. The cavity 22 may fully accommodate the stone 78 and the clasps 76. The plate 80, along with the post 72 and clamp 74 are illustrated extending away from the cover, unenclosed, however any portion of the ring may be enclosed without departing from the scope of the invention. Additionally, a space 32 may be provided between the earring 12 (more specifically the stone 78 and clasps 76) and the inner surface 26 of the cavity 22.

Figure 5:
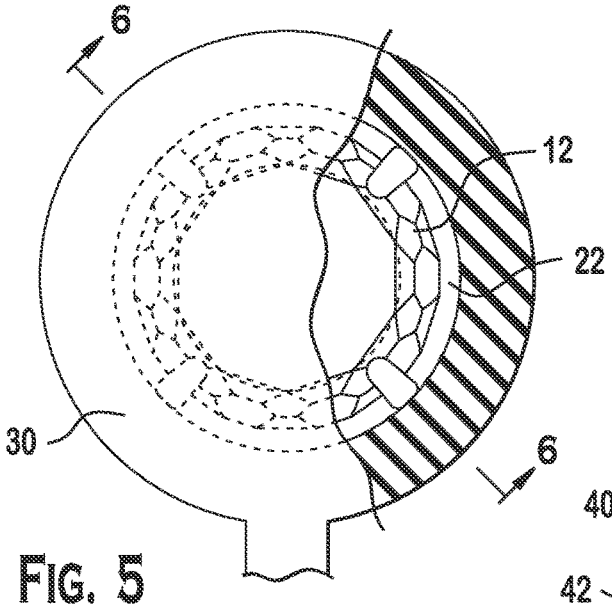
FIG. 5 is front, partial broken away view of an earring cover according to a second preferred embodiment illustrating the cover enclosing an earring with a stone, a plurality of clasps, a post, and a rear clamp; It should be noted that those of ordinary skill in the art will appreciate from this disclosure that any earring design, shape, or material be used in conjunction with the earring cover without departing from the scope of the invention.

Referring to FIG. 5, the cover 10 may also accommodate a round earring 12, similar in shape to the front surface 30 and cavity 22 as illustrated in FIG. 5. The cavity 22 maintains the full enclosure of the earring 12, however, less space remains between the earring 12 and the cavity 22 inner surface 26.

Figure 6:
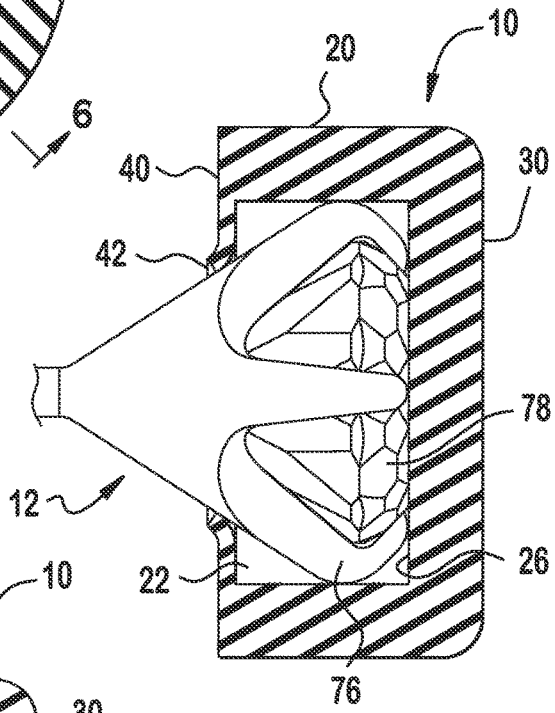
FIG. 6 is a cross-sectional view of the earring cover of FIG. 5 take along the line 6-6 in FIG. 5; The earring cover is shown completely enclosing the earring; Additionally, the lip of the second surface which defines the cavity opening is preferably deforming along the side portion of the ring, providing a sealed and fully enclosed environment for the earring; Preferably, the inner surface of the cavity contacts the outward surface of the earring, such as the stone and claps as illustrated in FIG. 6.
Figure 7:
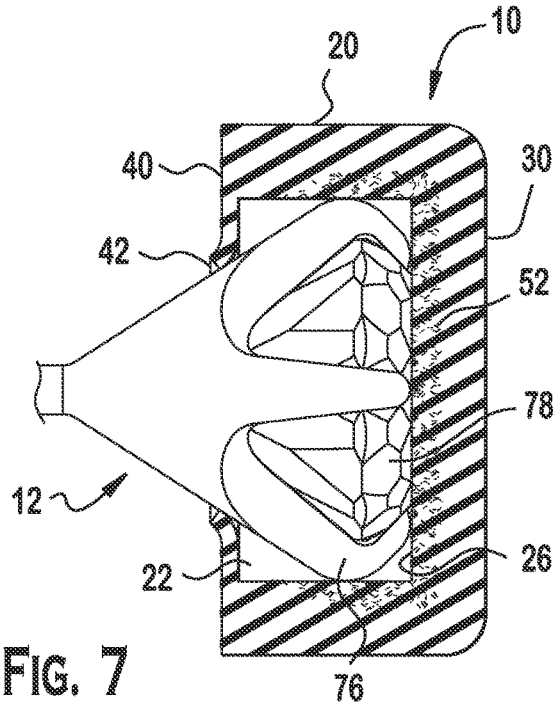
FIG. 7 is a cross-sectional view similar to that of FIG. 6 according to a third preferred embodiment of the present invention; The cavity is shown with a fluid disposed within a cavity inner surface forming a treatment interface between the earring and the interior surface of the cavity; The fluid is preferably a rubbing compound to improve the finish of the earring during use, however those of ordinary skill in the art will appreciate from this disclosure that any fluid, including water, or rubbing compound, such as metal polish, may be used without departing from the scope of the invention.
Figure 8:
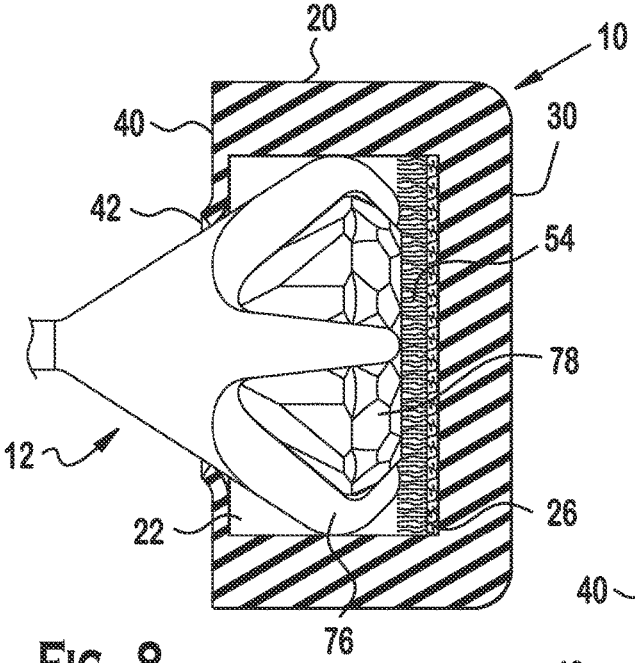
FIG. 8 is a cross-sectional view similar to that of FIG. 6 according to a fourth preferred embodiment of the present invention; The cavity is shown with a plurality of bristles disposed within the cavity inner surface forming a treatment interface between the earring and the interior surface of the cavity; The plurality of bristles are preferably configured to treat the surface of the earring in order to improve the finish of the earring; It should be noted that any number of bristles may be provided without departing from the scope of the invention.
Figure 9:
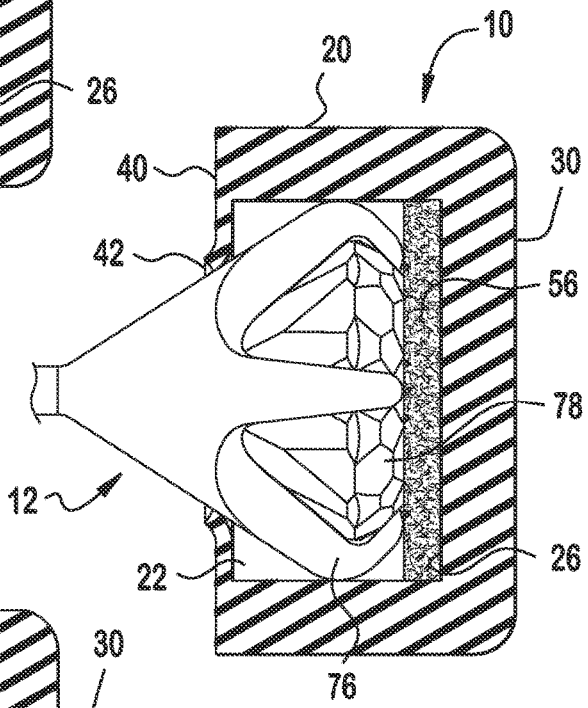
FIG. 9 is a cross-sectional view similar to that of FIG. 6 according to a fifth preferred embodiment of the present invention; The cavity is shown with a felt liner disposed within the cavity inner surface forming a treatment interface between the earring and the interior surface of the cavity; The felt liner is preferably configured to treat the surface of the earring in order to improve the finish of the earring; It should be noted that any material may be used in place of felt in order to provide an improved without departing from the scope of the invention.
Figure 10:
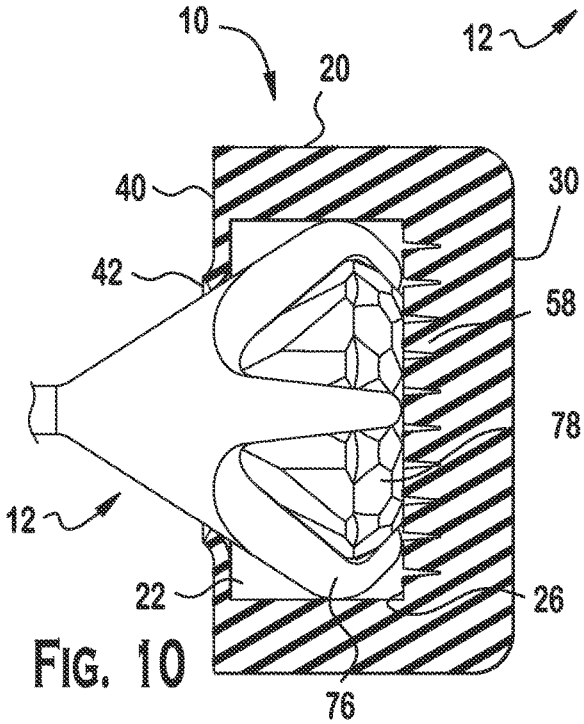
FIG. 10 is a cross-sectional view similar to that of FIG. 6 according to a sixth preferred embodiment of the present invention; The cavity is shown with a plurality of projections disposed within the cavity inner surface forming a treatment interface between the earring and the interior surface of the cavity; The plurality of bristles are preferably configured to treat the surface of the earring in order to improve the finish of the earring; The plurality of projections are preferably formed of the same material as the main body, however, any material may be used without departing from the scope of the invention.

Referring to FIGS. 6-10, several embodiments are shown illustrating the earring 12 fully in contact with the inner surface 26 of the cavity 22 forming a treatment interface. Specifically, FIG. 6 illustrates the stone 78 completely in contact with an inner surface of the cavity 22. The lip 42 is preferably resiliently deformable along the base of the earring 12 such that the stone 78 and clasps 76 are fully sealed off from outside elements and such that the earring 12 is fully retained within the cover 10. The lip 42 may deform along any portion of the earring 12 without departing from the scope of the invention. FIG. 7 illustrates the same configuration of the cover 10 as FIG. 6, however, a fluid 52 is disposed along the inner surface 26 of the cavity 22. The fluid is preferably a rubbing compound so as to provide a "polish" to the stone 78 during use, however, those of ordinary skill in the art will appreciate from this disclosure that any fluid, including water, may be used without departing from the scope of the invention. The sealing effect of the lip 42 along the base portion of the earring 12 retains all fluid within the cavity such that no leaking is permitted outside of the cover 10. FIG. 8 illustrates another embodiment of the cover of FIG. 6, including a plurality of bristles 54. The plurality of bristles 74 are configured to improve the appearance of the stone 78 during use. It should be noted, that while a stone 78 is illustrated, those of ordinary skill in the art will appreciate from this disclosure that any earring ornament or design may be used and still receive the benefits of the treatment interface surface of the cavity without departing from the scope of the invention. FIG. 9 illustrates another embodiment of the cover 10 of FIG. 6, including a felt liner 56. Similar to the previous embodiments, the felt liner 56 is configured to improve the finish of the stone 78, or similar ornament of the earring 12, during use of the cover 10. FIG. 10 illustrates another embodiment of the cover 10 of FIG. 6, including a plurality of projections 58 also configured to create a treatment interface within the cavity 22 to improve the appearance of the stone 78 or similar adornment.

Figure 11:
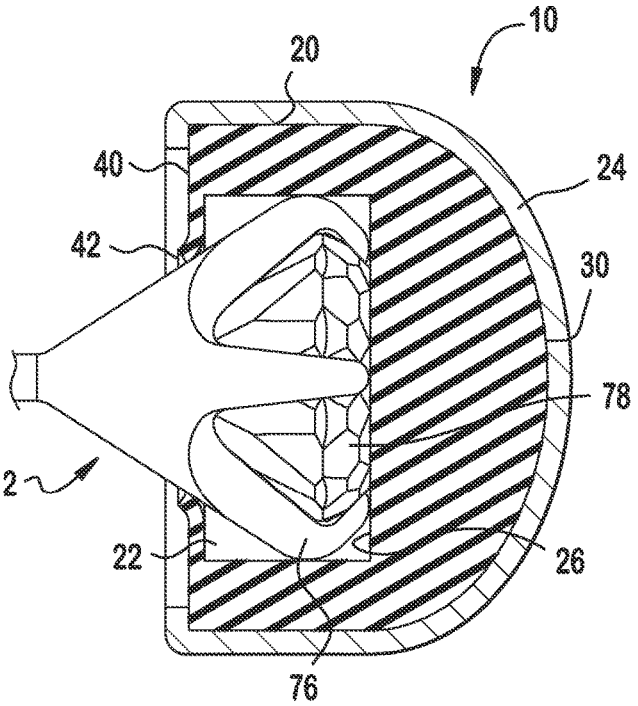
FIG. 11 is a cross-sectional view similar to that of FIG. 6 according to a seventh preferred embodiment of the present invention; The front surface of the main body is shown as a hemispherical shape; The earring cover may further include a casing enclosing the main body, including the first and second surfaces; It should be noted that any shape or combination of shapes of the cover and casing me be used without departing from the scope of the invention.

Referring to FIG. 11, the main body 20 may further comprise a front surface 30 configured in a hemispherical shape. Additionally, the main body 20, front surface 30, and second surface 40 may further include a casing 24 which fully encloses all of the main body, front surface, and second surface. The casing 24 is preferably a rigid material in order to provide additional structural rigidity and abrasion resistance, however, those of ordinary skill in the art will appreciate from this disclosure that any material may be used to form the casing, including the same material as the main body without departing from the scope of the invention. For example, the case may be formed from a metallic, composite, or similarly suitable material.

Figure 12:
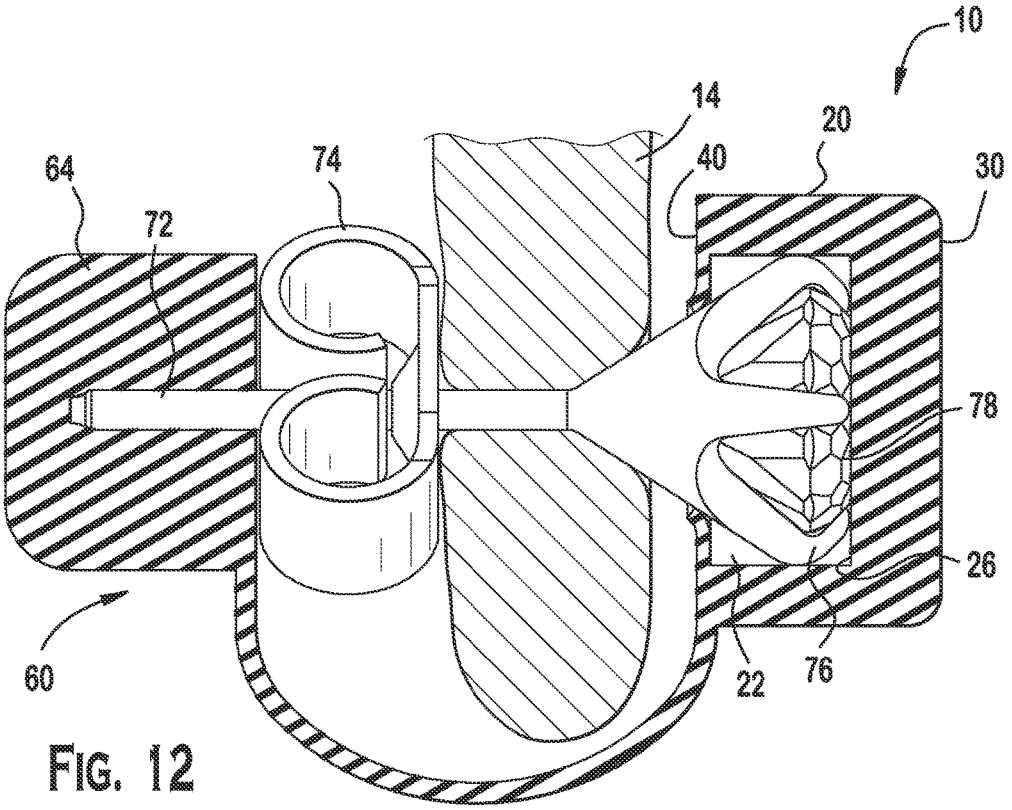
FIG. 12 is a cross-sectional view similar to that of FIG. 6 according to an eighth preferred embodiment of the present invention; The earring cover is shown with an earring in place in position on a user's ear; The earring cover may further include a hook attachment extending from the main body to the rear portion of the earring (and to the back of the user's ear); The hook attachment preferably attaches the post of the earring behind the clamp, however, the hook attachment may alternatively attach directly to the user's ear without departing from the scope of the invention.

Referring to FIG. 12, the cover 10 may further include a hook attachment 60. The hook attachment 60 preferably includes a bridge 62 and a post attachment 64 by which the hook attachment 60 secures to the earring 12 at an additional location. The hook attachment 60 may span below the ear 14 of the user as well as the clamp 74 of the earring 12. The hook attachment 60 may alternatively secure directly to the user's ear 14. In this embodiment, an additional point of attachment of the cover may ensure that the cover 10 does not fall off of the earring 12, and further that the earring 12 does not fall off of the user's ear 14, if attached directly to the ear.

Figure 13:
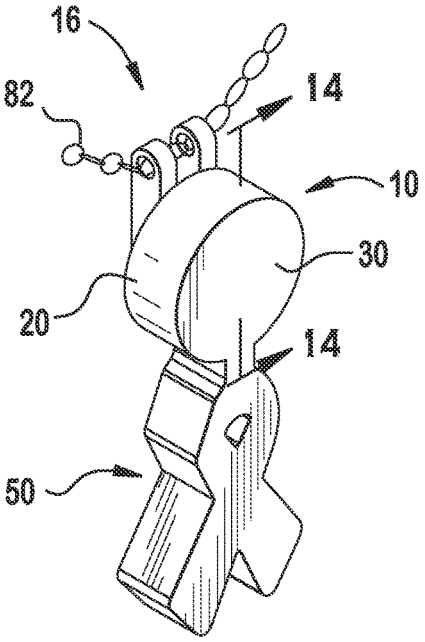
FIG. 13 is a perspective view of a ninth embodiment of the present invention; The cover is shown covering a piece of jewelry as an alternative to an earring; The jewelry cover may conceal a necklace as shown, however, any form of jewelry, such as a pendant or cuff-link, may be used in combination with the cover; The jewelry cover may further include the decorative attachment as seen in FIG. 1.

Referring to FIGS. 13-16, an additional embodiment of the present invention is shown. The additional embodiment provides a method for protecting decorative, finished, and non-adjustable jewelry. Referring to FIG. 13, the cover 10 is disposed on jewelry 16. The jewelry, as shown is a necklace, however, those of ordinary skill in the art will appreciate from this disclosure that any piece of jewelry, such as a pendant or cuff-link, may be used as well without departing from the scope of the invention. Similarly, the cover 10 may include a main body 20, front surface 30, and a decorative attachment 50.

Figure 14:
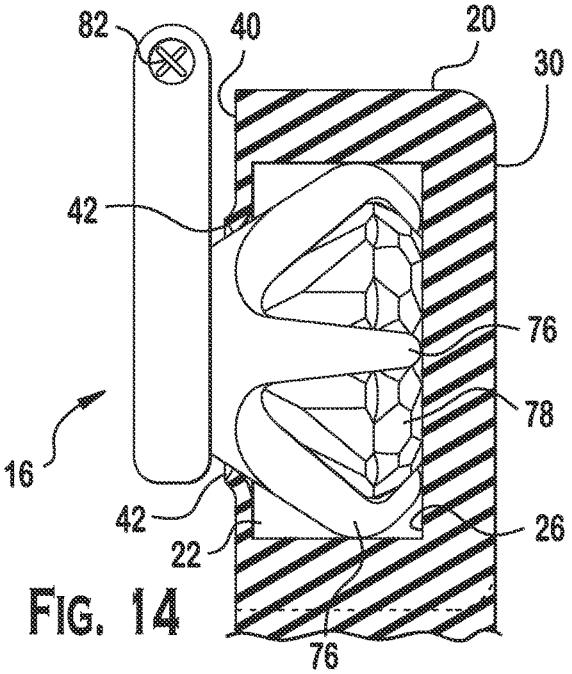
FIG. 14 is a side, partial cross-section view of the jewelry cover of FIG. 13; The cover may completely or partially conceal the piece of jewelry; The lips formed on the second surface of the main body of the cover may resiliently deform against the jewelry in order to seal and engage the jewelry within the cover.

Referring to FIG. 14, the cover 10 may enclose the jewelry in a similar method as the earring cover. The jewelry 16 may be engaged and sealed with lip 42 along the second surface 40. The cavity 22 is similarly defined to enclose the jewelry 16, which may include a stone 78 and clasps 76 directly in contact with the inner surface 26 of the cavity 22. The lip 42 additionally deforms against the surface of the jewelry 16, such that a seal is provided.

Figure 15:
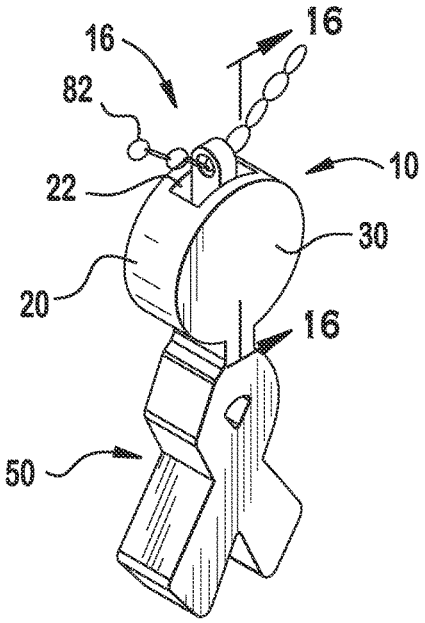
FIG. 15 is a perspective view of jewelry cover of FIG. 13 according to another embodiment; The main body of the jewelry cover may further comprise the deformable lips disposed about an opening of the cavity; The deformable lips may be configured to secure the jewelry within the main body, such that the opening is not being located on the first and second surfaces as illustrated in FIG. 15.

Referring to FIG. 15, an additional embodiment of the cover of FIG. 13 is provided. Specifically, the cavity 22 may be formed from along the main body 20. The main body 20 may further comprise the lip 42 disposed about an opening of the cavity 22 and configured to secure the jewelry within the main body. The opening, in contrast, is not located on either the first surface 30 or second surface 40.

Figure 16:
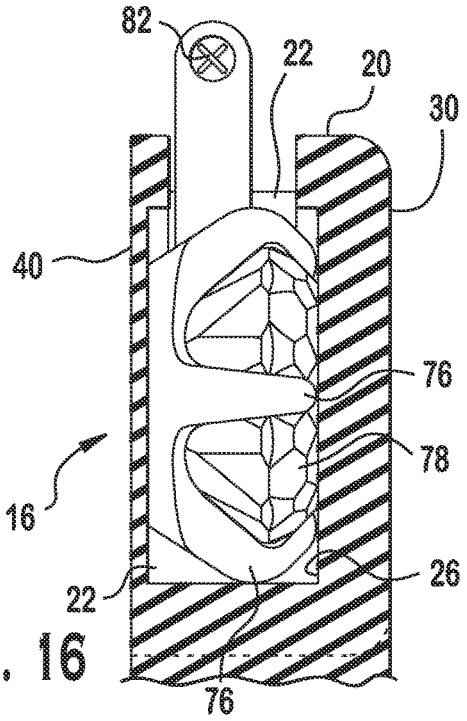
FIG. 16 is a side, partial cross-section view of the jewelry cover of FIG. 15; The jewelry may be enclosed within the main body and engaged with deformable lips formed along the main body on a surface separate from the first and second surfaces; The jewelry cover as shown in FIG. 16 is illustrated entering from an upward position relative to the main body, however, the jewelry cover may enclose the jewelry from any direction without departing from the scope of the invention.

Referring to FIG. 16, jewelry 16 may be enclosed by the cover 10 along a portion of the main body 20 disposed between the first and second surfaces 30, 40. The jewelry 16, which may include a stone 78 and clasps 76, may contact the inner surface 26 of the cavity 22.

It should be noted that those of ordinary skill in the art will appreciate from this disclosure that the present invention may further be used in accordance with an earring or jewelry which is adjustable, and as such, a user may dispose the cover on a plurality of earring or jewelry configurations without departing from the scope of the invention.

Referring to FIGS. 1-16, one preferred embodiment of the present invention operates as follows. A user places the cover 10 upon an earring 12 or jewelry 16 in order to conceal and protect the appearance and finish of the earring 12 or jewelry 16. An alternative embodiment may further allow the user to depress the first surface 30 in order to provide complete contact between the inner surface 26 and the earring 12 or jewelry 16 in order to establish the treatment interface and provide an improved visual appearance of the earring 12 or jewelry 16 once the cover 10 has been removed.

It is recognized by those skilled in the art that changes may be made to the above described methods without departing from the broad inventive concept thereof. It is understood, therefore, that this invention is not limited to the particular embodiments disclosed, but is intended to cover all modifications which are within the spirit and scope of the invention as defined by the above specification, the appended claims and/or shown in the attached drawings.

What is claimed is:

1. A method of protecting decorative, finished, and non-adjustable earrings, comprising the steps of:

providing a cover having a main body formed by a unitary, one piece member having first and second surfaces positioned on first and second axial ends of the main body, the first surface being configured to cover a side of an earring opposite from a back of the earring, wherein the earring is a decorative, finished, and non-adjustable adornment, the second surface of the main body defining a cavity therein configured to receive a portion of the earring therein, and the second surface comprises a deformable lip disposed about the cavity and configured such that the portion of the earring must be pushed through the second surface by displacing the deformable lip which thereafter secures the earring within the main body by at least one of: (1) the deformable lip returning to an original, non-deformed position to at least partially enclose the portion of the earring within the cavity; and (2) the deformable lip directly contacting the earring to form a restraint against removal of the earring from the cavity;

positioning the cover over the earring, the cover being configured such that when the earring is maximally inserted therein the earring is ready to be worn; and positioning the earring on a user's ear.

2. The method of claim 1, further comprising the step of providing the earring which is decorative, finished, and non-adjustable, and positioning the cover thereover such that a front of the earring is positioned within the cavity of the cover and retained by the deformable lip.

3. The method of claim 1, wherein the step of providing the cover further comprises the exterior of the main body comprising a metallic material with the exception of the deformable lip located on the second surface.

4. The method of claim 1, wherein the step of providing the cover further comprises the cavity being configured such that an interior cavity surface is spaced from a front surface of the earring.

5. The method of claim 1, wherein the step of providing the cover further comprises the cavity being configured such that an interior cavity surface forms a treatment interface that contacts a front surface of the earring.

6. A method of protecting decorative, finished, and non-adjustable jewelry, comprising the steps of:

providing a cover having a main body formed by a unitary, one piece member having first and second surfaces positioned on first and second axial ends of the main body, the first surface being configured to cover a side of the jewelry opposite from a back of the jewelry, wherein the jewelry is a decorative, finished, and non-adjustable adornment, the second surface of the main body defining a cavity therein configured to receive a portion of the jewelry therein, and the second surface further comprising a deformable lip disposed about the cavity and configured such that the portion of the jewelry must be pushed through the second surface by displacing the deformable lip which thereafter secures the jewelry within the main body by at least one of: (1) the deformable lip returning to an original, non-deformed position to at least partially enclose the portion of the jewelry within the cavity; and (2) the deformable lip directly contacting the jewelry to form a restraint against removal of the jewelry from the cavity;

positioning the cover over a side of the jewelry, the cover being configured such that when the jewelry is maximally inserted therein the jewelry is ready to be worn; and the user wearing the jewelry.

7. The method of claim 6, further comprising the step of providing the jewelry which is decorative, finished, and non-adjustable, and positioning the cover thereover such that a front of the jewelry is positioned within the cavity of the cover and retained by the deformable lip.

8. The method of claim 6, wherein the step of providing the cover further comprises the cavity being configured such that an interior cavity surface is spaced from a front surface of the jewelry.

9. The method of claim 6, wherein the step of providing the cover further comprises the cavity being configured such that an interior cavity surface forms a treatment interface that contacts a front surface of the jewelry.

10. A method of protecting decorative, finished, and non-adjustable jewelry, comprising the steps of:

providing a cover having a main body formed by a unitary, one piece member having first and second surfaces positioned on first and second axial ends of the main body, the first surface being configured to cover a side of the jewelry opposite from a back of the jewelry, wherein the jewelry is a decorative, finished, and non-adjustable adornment, the second surface of the main body defining a cavity therein configured to receive a portion of the jewelry therein, and the second surface further comprising a deformable lip disposed about the cavity and configured such that the portion of the jewelry must be pushed through the second surface by displacing the deformable lip which thereafter secures the jewelry within the main body by at least one of: (1) the deformable lip returning to an original, non-deformed position to at least partially enclose the portion of the jewelry within the cavity; and (2) the deformable lip directly contacting the jewelry to form a restraint against removal of the jewelry from the cavity, the exterior of the main body further comprising a metallic material with the exception of the deformable lip located on the second surface.

* * * * *